US006036511A

United States Patent [19]

Hashimoto

[11] Patent Number: 6,036,511

[45] Date of Patent: Mar. 14, 2000

[54] CARD CONNECTOR

[75] Inventor: Shinichi Hashimoto, Tokyo, Japan

[73] Assignee: The Whitaker Corporation, Wilmington, Del.

[21] Appl. No.: 09/047,277

[22] Filed: Mar. 24, 1998

[30] Foreign Application Priority Data

Mar. 24, 1997 [JP] Japan ..... 9-088959
Dec. 2, 1997 [JP] Japan ..... 9-347085

[51] Int. Cl.[7] ..... H01R 13/62
[52] U.S. Cl. ..... 439/159
[58] Field of Search ..... 439/159, 160

[56] References Cited

U.S. PATENT DOCUMENTS 5,653,603 8/1997 Sasao et al. ..... 439/159
5,707,245 1/1998 Yamamoto et al. ..... 439/160
5,740,012 4/1998 Choi ..... 439/159
5,791,920 8/1998 Tomioka et al. ..... 439/159

FOREIGN PATENT DOCUMENTS 4-86970 7/1992 Japan ..... G06K 17/00
5-75974 10/1993 Japan ..... H01R 13/629

*Primary Examiner*—Steven L. Stephan
*Assistant Examiner*—J. F. Duverne

[57] ABSTRACT

Card connector 10 includes a housing 30, a sliding lever 50 and a cam member 70 which cooperate to eject a card received within the card connector. In a side 33*b* of the housing 30, a recess 21 and a cantilever arm 36 overlapping the recess 21 are provided. When a pivot 72*a*, 72*b* of the cam member 70 is inserted in the recess 21, the cantilever arm is bent allowing for the insertion of the cam member 70. After the cam member 70 is inserted to its predetermined position in the recess, the cantilever arm returns to its original position locking the cam member in place. A spring 90 of metal wire is mounted along a front edge of the housing 30 springably engaging lever 50.

19 Claims, 11 Drawing Sheets

CARD CONNECTOR

FIELD OF THE INVENTION

This invention relates to card connectors receiving memory cards and other types of cards equipped with a means of card ejection.

BACKGROUND OF THE INVENTION

An example of a card connector of such a type can be found in Japanese Utility Model Publication No. 92-86970 and Japanese Utility Model Publication No. 93-75974. Both card connectors described in these publications have a cam member mounted in a rotational manner in the housing accommodating the card and a sliding lever linked to the cam member. In these card connectors, the cam members can be rotated by pushing the lever in an assigned direction, thus causing the ejection of the card inserted in the connector. In the second card connector, a spring is provided which at all times applies spring force to the lever in the direction opposite to the direction the lever is pushed to eject the card.

However, the above card connectors needed improvements because they had relatively complicated structure and were difficult to assemble. Therefore, the purpose of the present invention is to offer a card connector having less complicated structure and an easier assembly process.

SUMMARY OF THE INVENTION

The present invention comprises a card connector including a cam member mounted in a rotational manner in a housing accommodating a card intended for the ejection of the card by means of cam member rotation wherein a recess is provided in the housing and opens to a side of the housing, the purpose of the recess is to house the cam member, a cantilevered arm is provided overlapping the recess and is pressed and bent into the recess by the cam member when the cam member is mounted in the recess and which returns to its initial position when the cam member reaches its prescribed position, thus locking the cam member in place while making it possible for the cam member to rotate in the recess.

It is preferable that the recess has an opening oriented perpendicularly to an outside surface of the housing and that its rear portion is of a curved configuration. Before the insertion of the cam member, the cantilever arm extends so that its free end overlaps the recess. The free end of the cantilever arm locks the cam member in place while making it possible for it to rotate.

In addition, the present invention is directed to a card connector having a cam member mounted in a housing accommodating the card, a lever engaged with the cam member can slide relative to the housing and move the cam member when the lever is slid in a predetermined direction, thus ejecting the card, and a spring connected to the lever which at all times presses the lever in the direction opposite to the predetermined direction, wherein the spring is a metal wire and is secured in the housing in the direction which is substantially perpendicular to the sliding direction of the lever.

The metal wire is mounted along a forward edge of the housing forming a cantilevered configuration. The wire can be mounted in a deformed condition and is arranged in such a manner that it continuously exerts pressure on the lever. The metal wire has an axle bent at a right angle which is disposed in an opening in the housing. The metal wire is supported at least at two locations along its longitudinal length. The wire can be a steel piano wire.

BRIEF DESCRIPTION OF THE DRAWINGS

Embodiments of the present invention will now be described by way of example with reference to the accompanying drawings in which:

FIG. 7*b* is a view looking from the bottom of FIG. 7*a*, FIG. 7*c* is a bottom view of FIG. 7*a*, and FIG. 7d is a view looking from the right of FIG. 7*c*.

DETAILED DESCRIPTION OF THE INVENTION

Figure 1A:
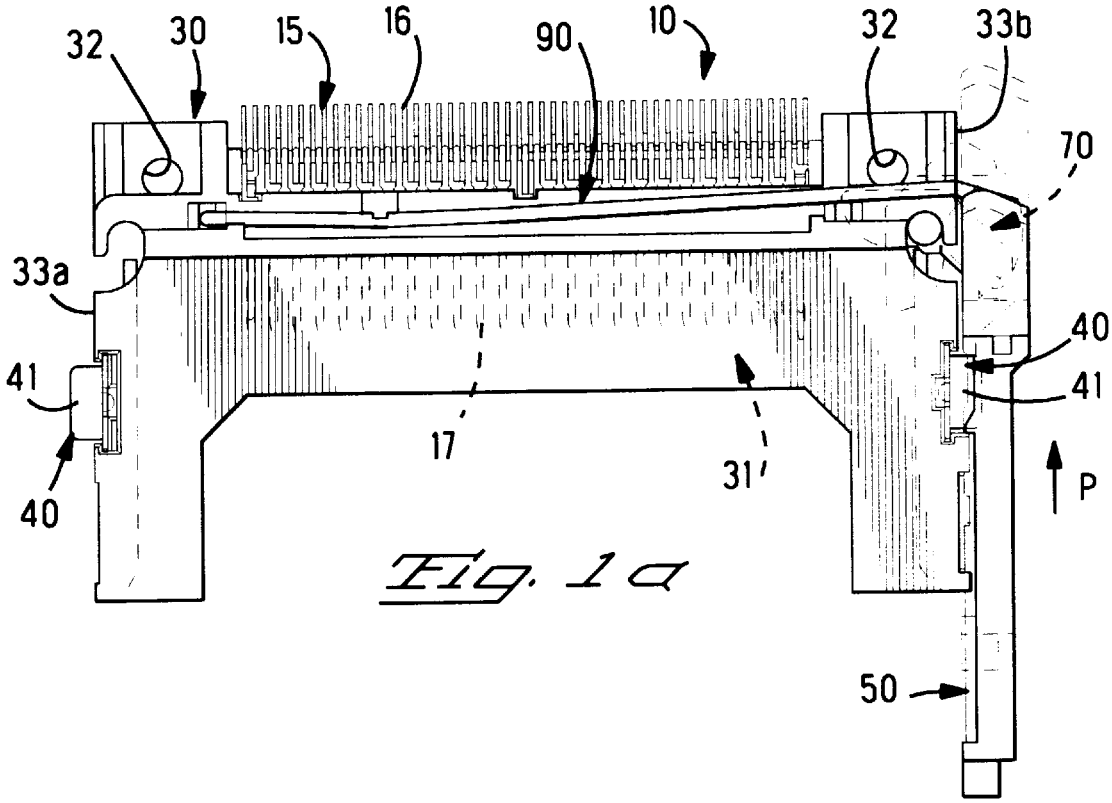
FIG. 1*a* is a top plan view of a card connector of the present invention showing a lever in a rearward position.
Figure 1B:
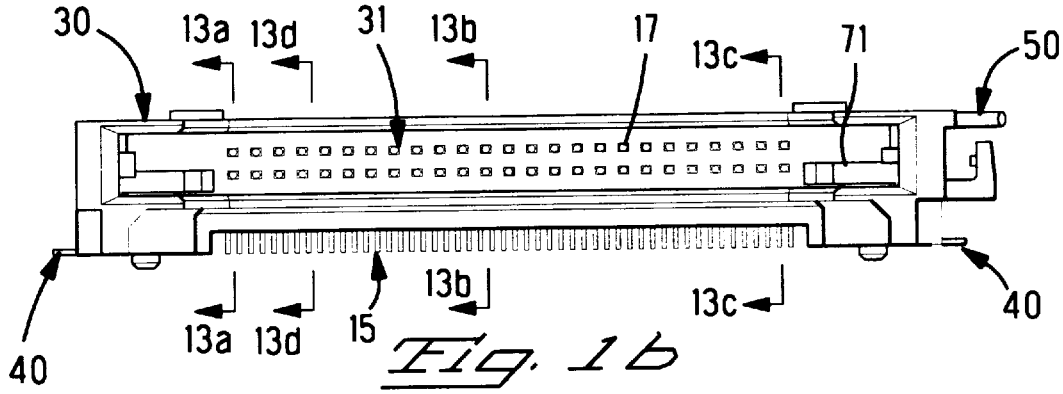
FIG. 1*b* is a view looking from the bottom of FIG. 1*a*.
Figure 1C:
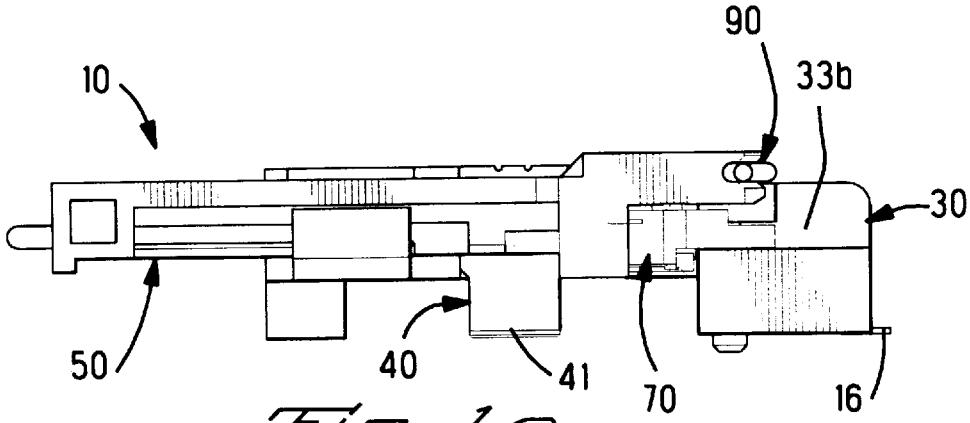
FIG. 1*c* is a view looking from the right of FIG. 1*a*.
Figure 2A:
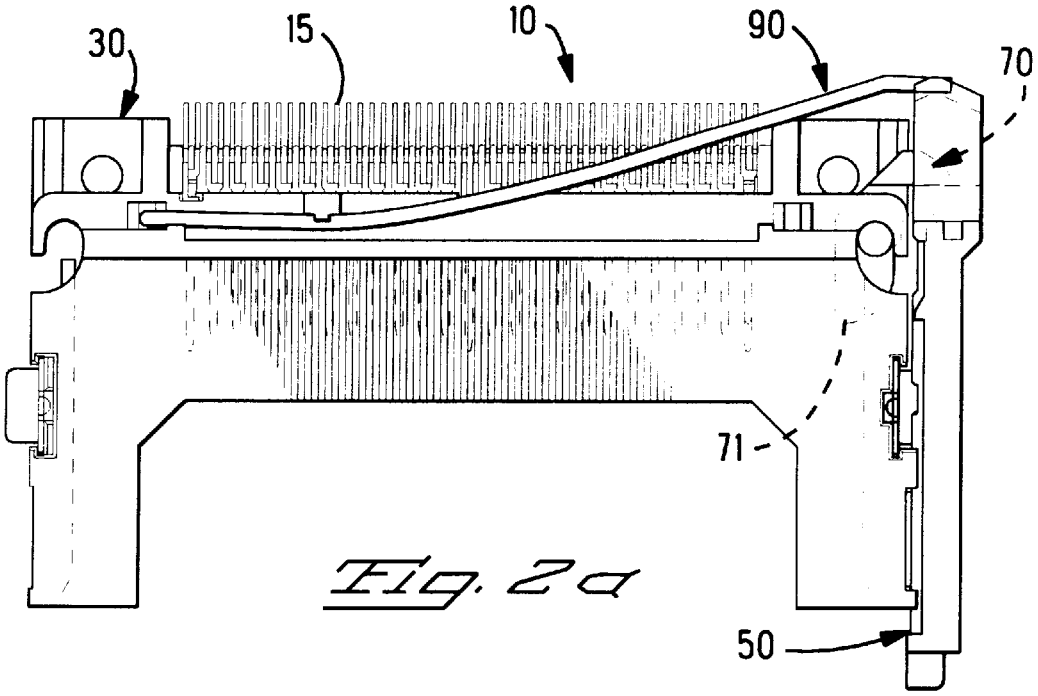
FIG. 2*a* is a top plan view of the card connector of FIG. 1*a* showing the lever in a forward position.
Figure 2B:
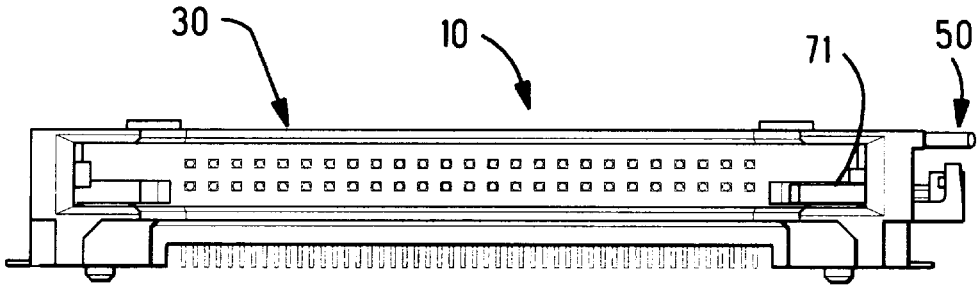
FIG. 2*b* is a view looking from the bottom of FIG. 2*a*.
Figure 2C:
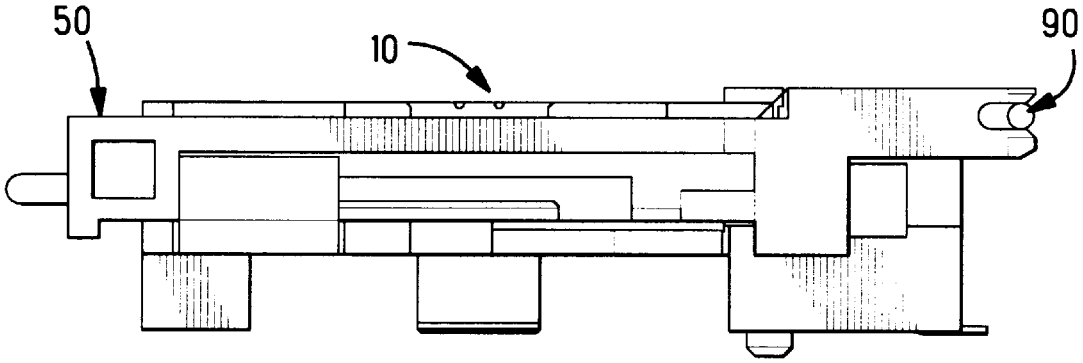
FIG. 2*c* is a view looking from the right of FIG. 2*a*.

As it is clear from FIGS. 1–13, card connector 10 has multiple electrical contacts 15 and a dielectric housing 30 in which the contacts are arrayed. As can be seen from FIGS. 1*a*–1*d*, the housing 30 has a card-receiving section 31 into which memory cards can be inserted. In the card-receiving section 31, contact sections 17 of contacts 15 are arranged. The card connector 10 is designed for flash memory cards or other memory cards. The card connector 10 is intended for mounting on printed circuit boards (not shown) for which purpose the connector has holes 32 for mounting screws. In addition, auxiliary reinforcing fixtures 40 are provided on sides 33*a*, 33*b* of the housing 30 the purpose of which is to make mechanical connection to the circuit board more reliable. Multiple contacts 15 and auxiliary reinforcing fixtures 40 have soldering sections 16 and 41 respectively for soldering to the board by SMT technology. They are soldered to soldering pads prepared on the printed circuit board (not shown).

The card connector 10 also has an ejection mechanism for the ejection of a card (not shown) inserted in the card-receiving section 31 of the connector. The ejection mechanism includes a lever 50 arranged so that it can slide along the side 33*b*, a cam member 70 secured to the housing 30 in a pivoting manner and a linear spring 90 of spring metal wire. Configurations of all parts are discussed in detail below.

Operation of the ejection mechanism can best be understood by following movements of all parts as shown in FIGS. 1*a*–1*c* and 2*a*—2*c*. The cam member 70 has an ejection leg 71 pressing against a card edge. When the cam member 70 is rotated, the ejection leg 71 presses on the card, thus ejecting it outside the connector. The cam member 70 is engaged with the lever 50 (for details, see below). Therefore, when the lever 50 is pressed in the forward direction (shown in FIG. 1*a* by arrow P), the cam member 70 is rotated causing card ejection. The spring 90 presses on the lever 50 in the opposite direction and after the card has been ejected, it returns the lever 50 from the position shown in FIG. 2*a* to its initial position shown in FIG. 1*a*. Below, the assembly of the card connector 10 will be explained.

Figure 3:
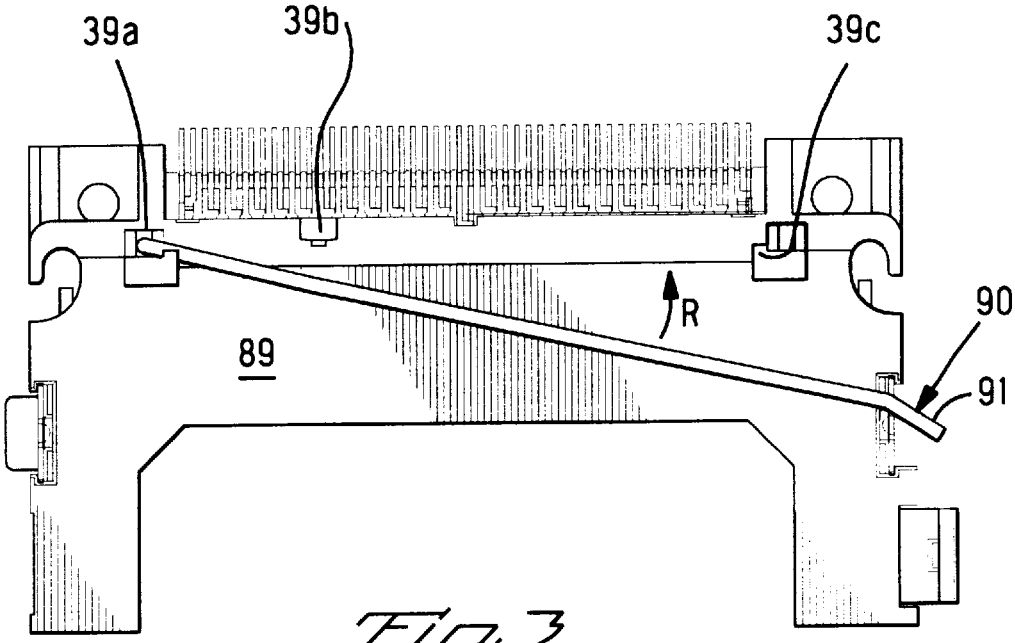
FIG. 3 is a top plan view of the card connector of FIG. 1*a* showing the card connector in a first stage of assembly.
Figure 4A:
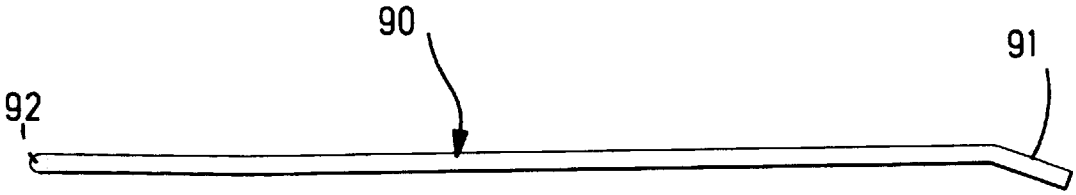
FIG. 4*a* is a top plan view showing a spring member used in the card connector.
Figure 4B:
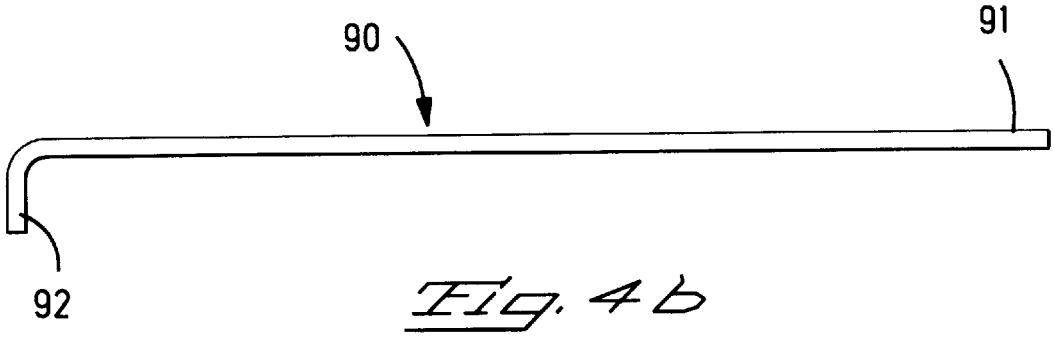
FIG. 4*b* is a view looking from the bottom of FIG. 4*a*.

The first stage of assembly involves the installation of the spring 90 on the housing 30 with multiple electrical contacts secured therein. Since contacts 15 are fixed by a commonly-known method by pressing them in the housing, description thereof is omitted. The spring 90 mounted on the housing 30 can be made of a steel wire, for example, a piano wire. In this embodiment, it is made of SWP-A grade piano wire. As shown in FIGS. 4*a*, 4*b*, one end 91 of the spring 90 which is intended for the connection to the lever 50 is obliquely bent. The other end is bent substantially perpendicular to the direction of the bent end 91, thus forming a pivot 92. Housing 30 has an opening 39*a* into which the pivot 92 is inserted and retained, a lug 39*b* at some distance from the opening 39*a* supports the spring 90 from the other side and another lug 39*c* located near the end 91 of the spring 90 is intended for a temporary support of the spring. These retaining means are along a front end of the housing 30. The mounting of the spring 90 begins with the pivot 90 being inserted in the opening 39*a*. After that, the spring 90 can freely rotate around the opening 39*a* as the center of rotation. Next, the spring 90 is placed over a wall 89 of the housing 30 on the card insertion side 31. This state is shown in FIG. 3. The spring 90 is rotated in a direction indicated by arrow R. The spring 90 is moved in this direction sliding along the wall 89 until it reaches retaining lug 39*b* and temporary retention lug 39*c*. When the spring 90 is in a position nearly overlapping these retention means, it is pressed downward so that it is engaged with lugs 39*b* and 39*c*. As can be seen from FIG. 5*a*, the spring 90 is reliably secured and only slightly deformed by retention points at the opening 39*a*, lug 39*b* and temporary retention lug 39*c*.

The second stage of the assembly involves the installation of the cam member 70 in the housing 30. Configuration of the cam member 70 is shown in FIGS. 7*a*–7*d*. Cam member 70 has a flat base section 74, pivot members 72*a*, 72*b* extending up and down from approximately the center of the base section 74, and engaging sections 73*a*, 73*b* extending up and down from one end of the base section 74. The engaging sections 73*a*, 73*b* are intended for engagement with the lever 50 according to the explanation below. On the end of the base section 74, which is opposite to the end where the engaging sections 73*a*, 73*b* are located, a card-ejection section 71 is located. The pivot members 72*a* and 72*b* are of the same size and have a symmetrical configuration. The engaging sections 73*a*, 73*b* are not symmetrical in the vertical direction, but surfaces 76, 77 are common for both members and they connect together connecting sections 73*a*, 73*b* forming an engaging end 78. An especially important feature is the surface 75 of the engaging section 73*b*, the purpose of which is explained below.

Figure 5A:
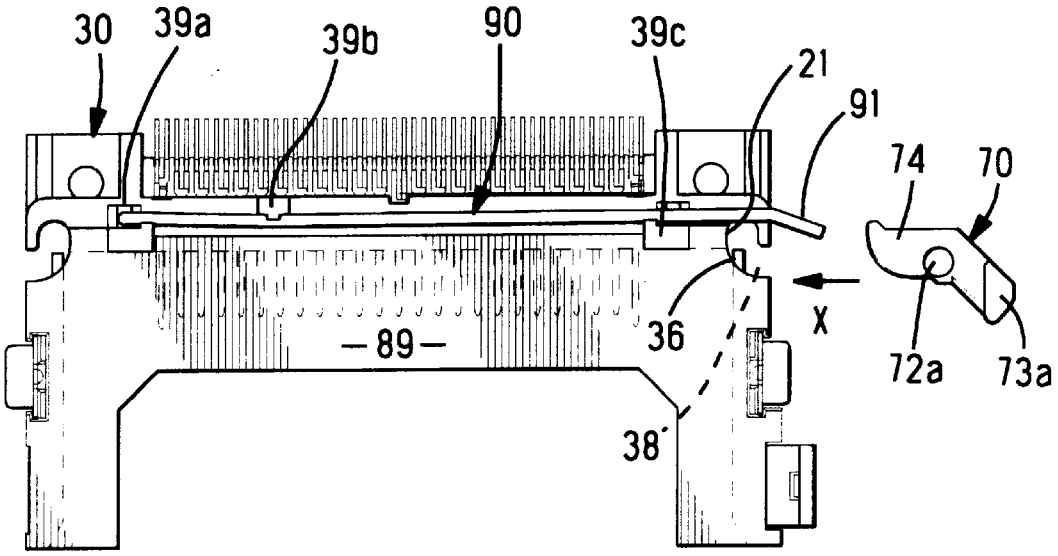
FIG. 5*a* is a top plan view of the card connector of FIG. 1*a* showing the completion of the first stage of assembly and preparation for the second stage of assembly.
Figure 5B:
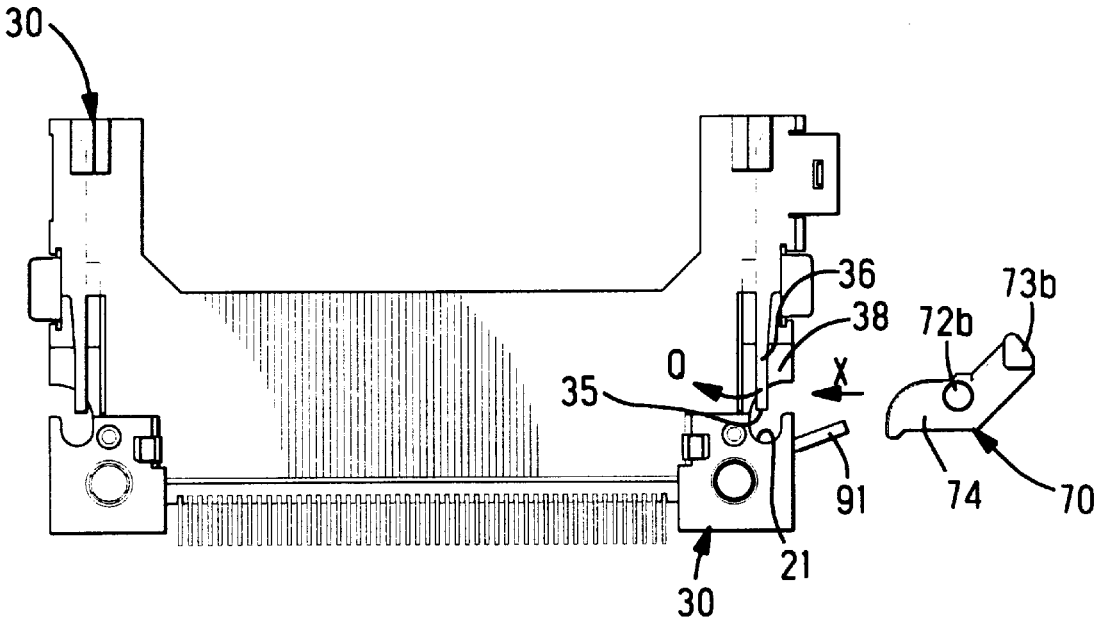
FIG. 5*b* is a bottom view of FIG. 5*a*.
Figure 6A:
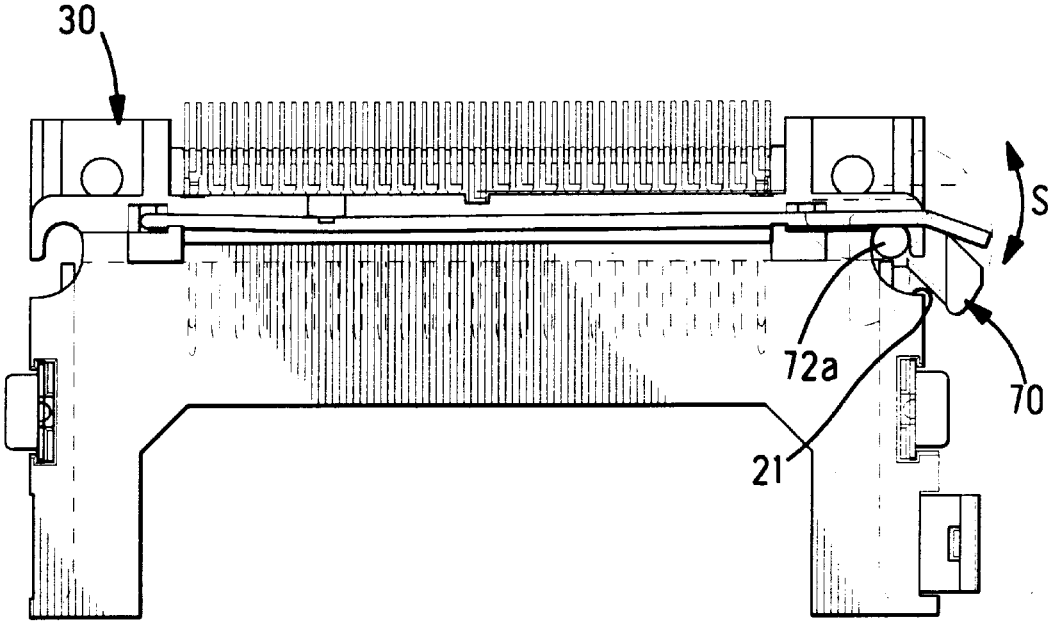
FIG. 6*a* is a top plan view showing the completion of the second stage of assembly.
Figure 6B:
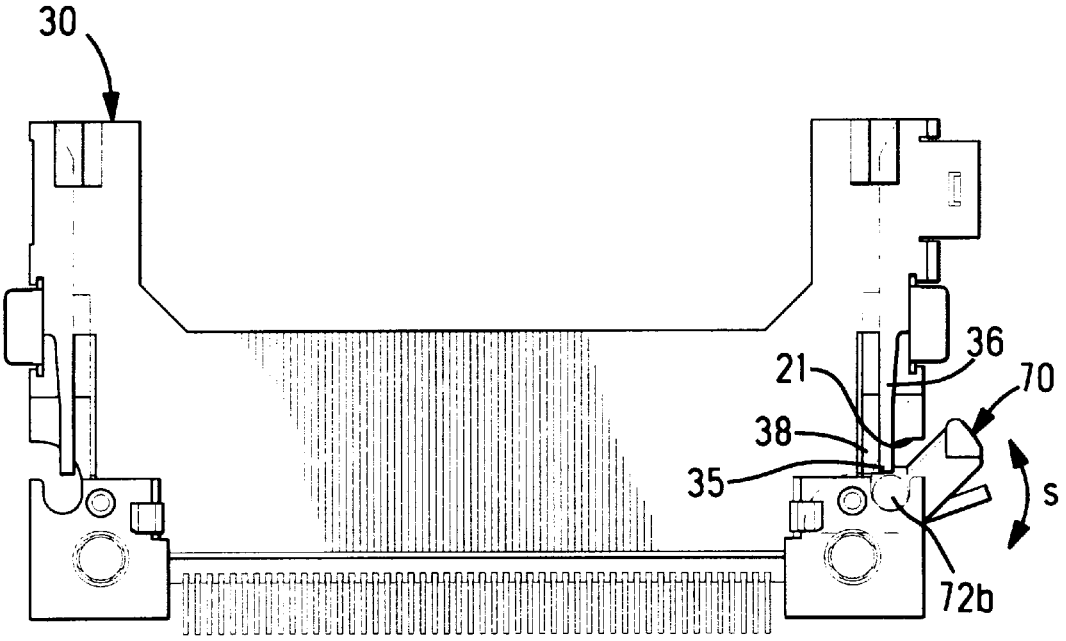
FIG. 6*b* is a bottom view of FIG. 6*a*.
Figure 7A:
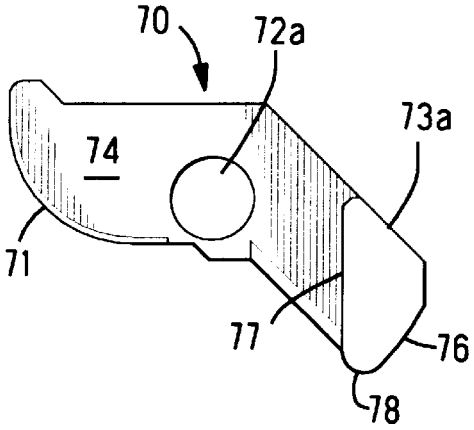
FIGS. 7*a*–7*d* are respective views of a cam member with FIG. 7*a* being a top plan view.
Figure 7C:
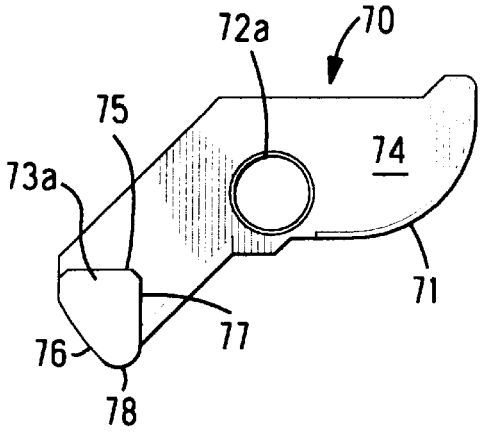
Figure 7B:
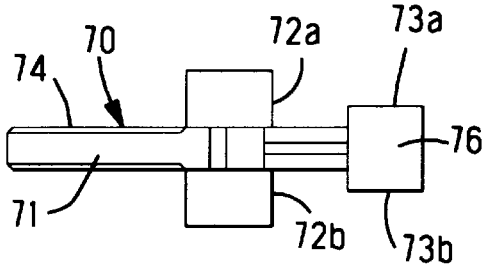
Figure 7D:
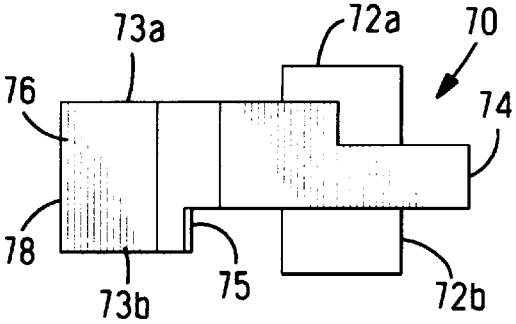

When the cam member 70 is installed, it is moved in the direction shown by arrow X in FIGS. 5*a*, 5*b*. As can be seen, a recess 21 is formed at the edge of the top wall 89 of the housing 30, so that its opening is substantially perpendicular to the side 33*b* and the rest of the recess 21 is curved toward the front end of the housing. The recess 21 is in communication with the space 38 linked to the card-receiving section 31. In the lower part of the space 38, a cantilevered arm 36 is located so that its end extends into the recess 21 toward the rear of the card-receiving section 31. During assembly, the base section 74 of the cam member 70 is inserted in the space 38 so that the pivot member 72*a* is aligned with the recess 21. At this time, the pivot member 72*b* is located at the same level as the arm 36. Therefore, in order to insert the cam member 70 in the housing 30, it is necessary to advance the pivot member 72*a* inside the recess 21 so that contact is formed between the pivot member 72*b* and the arm 36. When the cam member 70 is advanced further, the arm 36 is bent inward in the direction indicated by arrow Q (see FIG. 5*b*) so that the pivot member 72*a* can be advanced even further inside recess 21. Since as mentioned above recess 21 is curved toward the rear, the pivot member 72*a* is guided toward the rear along the curve. When the pivot member 72*a* reaches the predetermined position, that is the deepest part of the recess 21, the engagement between the pivot member 72*b* and the arm 36 is discontinued, and the arm 36 returns to its initial non-bent position and its end 35 locks the pivot member 72*b* in place in recess 21. Therefore, cam member 70 is secured in position in the housing 30 as shown in FIGS. 6*a*, 6*b* so that it can rotate. Arrow S indicates directions in which the cam member can rotate.

The third stage of the assembly involves the installation of the lever 50. The steps of the lever installation are shown in FIGS. 8–12.

Figure 12:
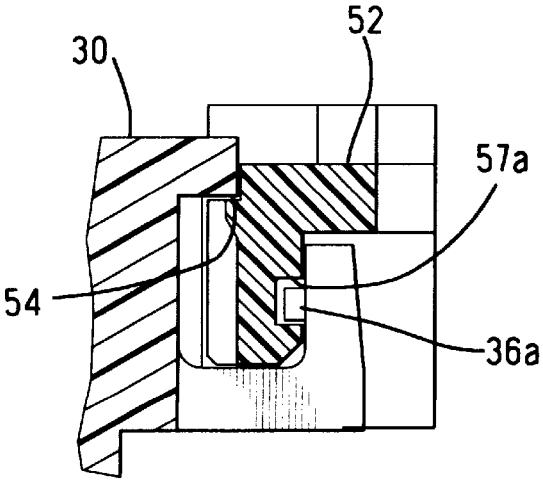
FIG. 12 is a cross-sectional view taken along line 12—12 of FIG. 10.
Figure 8:
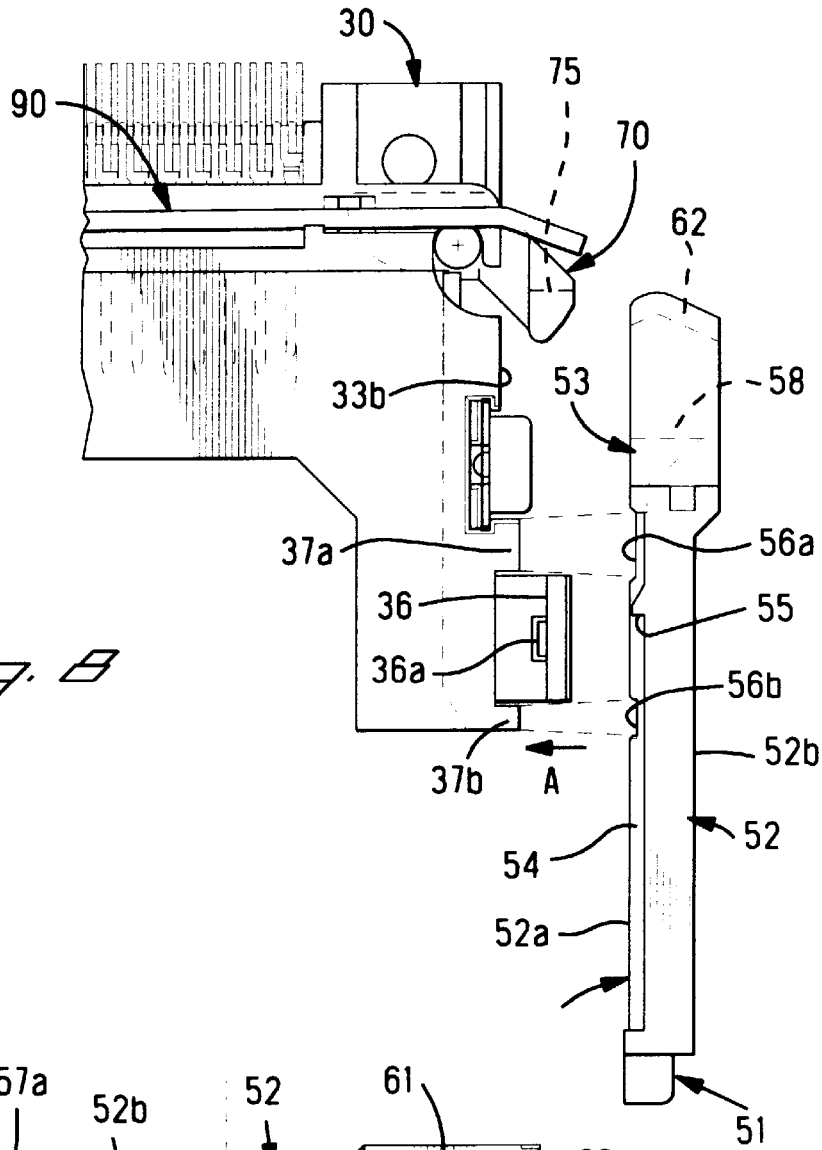
FIG. 8 is a part top plan view of the card connector showing the first stage of assembling the lever thereto.
Figure 9:
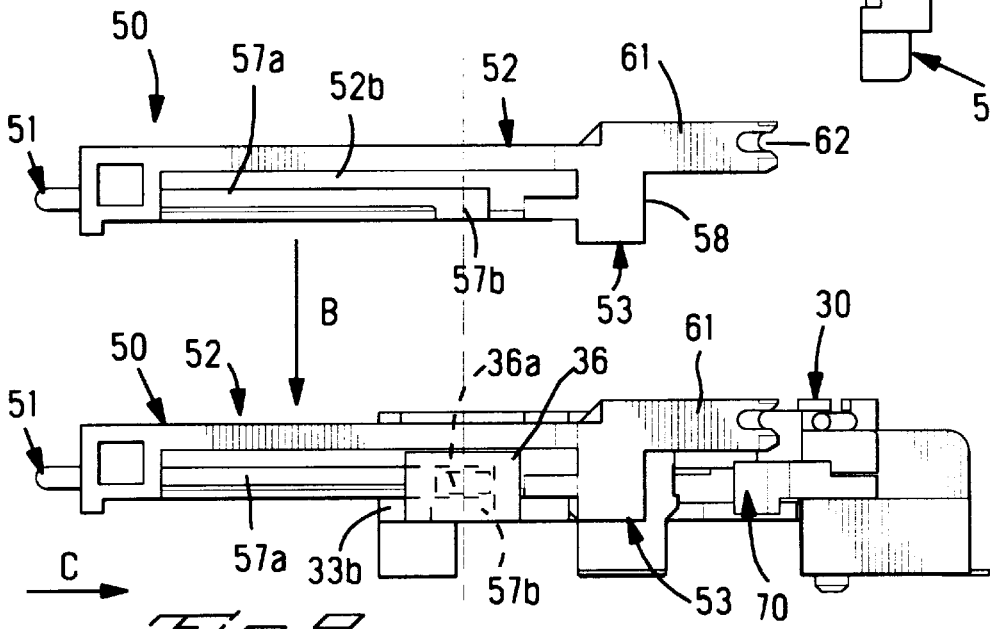
FIG. 9 is a view looking from the right of FIG. 8 showing a second stage of assembling the lever to the card connector.

The configuration of the lever 50 can be seen in FIGS. 8, 9 and 12. The lever 50 includes a mounting extension 51 for attachment of an operating button, a main body 52 and a connecting section 53 for engagement with the cam member 70. The operating button is not shown in the drawing, but any type of button according to the customer needs can be affixed to the mounting extension 51. An inside surface 52*a* of the main body 52 facing the housing 30 has a step 54 extending therealong. The step 54 has a catch 55. At two locations along the length of the inside surface 52*a*, slots 56*a*, 56*b* are located. The slot 56*a* is wider than the slot 56*b*. As shown in FIG. 12, the main body 52 has an L-shape cross section, and as can be seen from FIG. 9, a slot 57*a* in communication with an opening 57*b* is formed in the longitudinal direction of the outer surface 52*b* of the main body 52. It should be noted that, as shown in FIG. 9, the opening 57*b* is opened downward. Thus, slot 57*a* and opening 57*b* form an L-shape. The connecting section 53 has a contact surface 58 which engages with the contacting end 78 of cam member 70, and an extension 61 protruding forward from an upper portion of the contact surface 58. As shown in FIGS. 8, 9, a groove 62 is located in a front end of the extension 61. From FIG. 9, it can be seen that the groove 62 has a U-shape profile and extends along the edge of the front end of the extension 61. The operation of this arrangement is explained below.

According to FIG. 8, on the side 33*b* of the housing 30 to which the lever 50 is to be attached, keys 37*a*, 37*b* of different widths are located. An L-shaped lever-supporting arm 36 fits between keys 37*a*, 37*b*. Near the center of the inner side of the lever-supporting arm 36, a rib 36*a* is located (see FIG. 12).

During the first stage of assembly, the lever 50 is placed relative to the housing 30 as shown in FIGS. 8, 9. As shown in FIG. 8, the lever 50 is positioned so that keys 37*a*, 37*b* and key slots 56*a*, 56*b* are aligned; then the lever 50 is moved in the direction shown by arrow A so that it overlaps the lever-supporting arm 36.

During the second stage of assembly, the lever 50 is moved in the direction indicated by arrow B (FIG. 9) so as to be attached to the side 33*b* of the housing 30. At this time, if the parts are aligned correctly during the first stage of assembly, keys 37*a*, 37*b* are inserted in the slots 56*a*, 56*b*, thus making it possible to move the lever 50 to a predetermined height. During this movement, the rib 36*a* is disposed within the opening 57*b* in the outer surface 52*b* of the lever 50. When the lever 50 reaches the predetermined position, the rib 36*a* is at the top of the opening 57*b* (see FIG. 9) in alignment with slot 57*a*.

Figure 10:
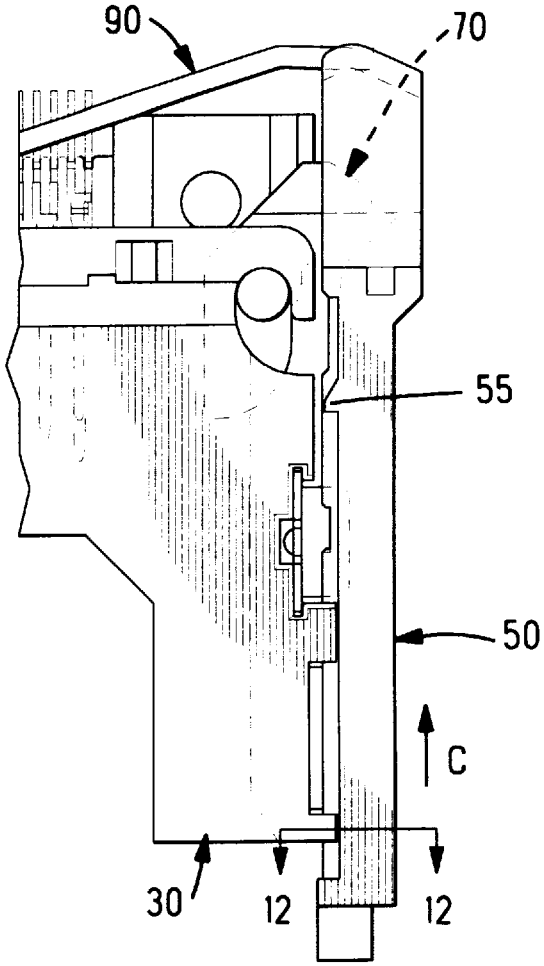
FIG. 10 is a view similar to FIG. 8 showing the third stage of assembling the lever to the card connector.

During the third stage of assembly, the lever 50 is moved in the direction shown by arrow C in FIGS. 9, 10, that is it is pushed forward. At the end of this movement, the lever 50 reaches the extreme forward position. In this position, rotation of the cam member 70 is blocked due to contact between the surface 75 of the cam member 70 and the side 33*b* of the housing 30 (see FIGS. 7, 8). The blocking action of the cam member 70 caused by the contact between the surface 75 and the side 33*b* takes place not only during the mounting of the lever 50 but every time during card ejection. As shown in the drawings, in the extreme forward position of the lever 50, the groove 62 in the end of the lever 50 and the end 91 of the spring 90 are engaged and the spring 90 is bent back.

Figure 11:
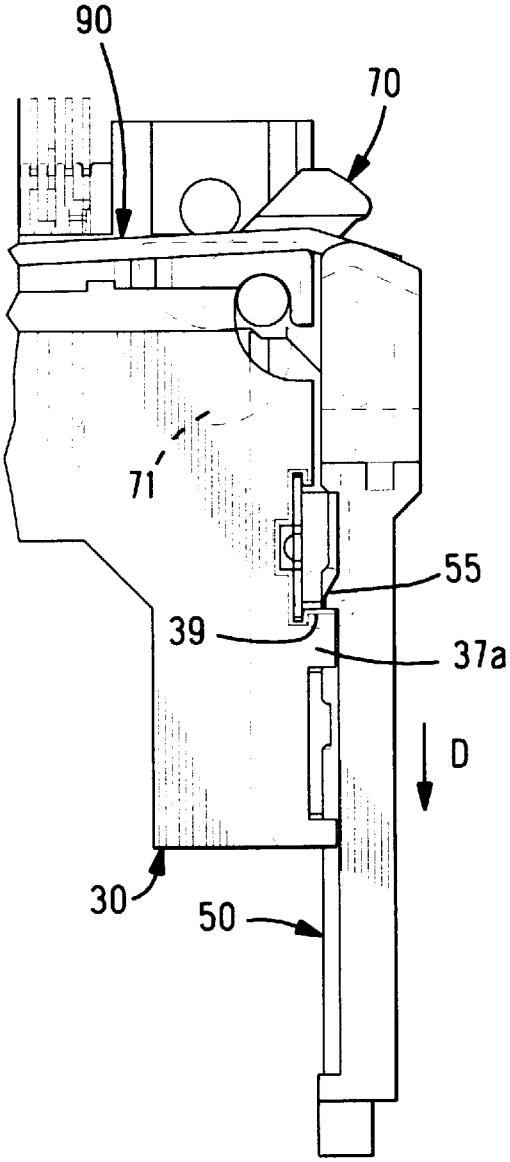
FIG. 11 is a view similar to FIG. 10 showing the fourth stage of assembling the lever to the card connector.
Figure 13A:
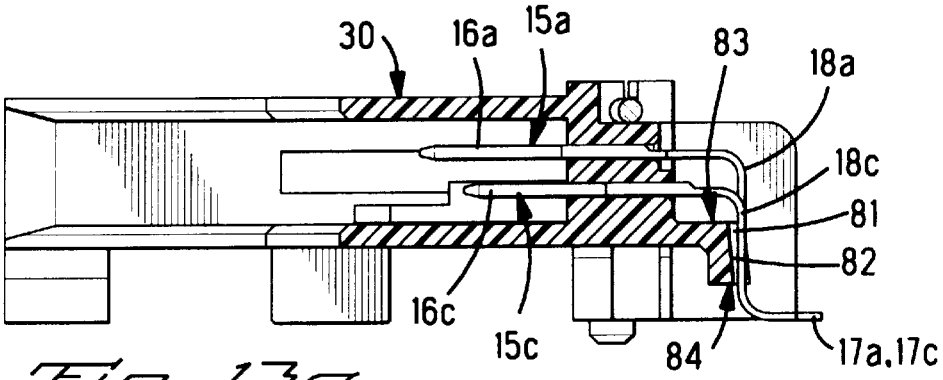
FIGS. 13*a*–13*d* are respective cross-sectional views taken along lines 13*a*—13*a*, 13*b*—13*b*, 13*c*—13*c*, and 13*d*—13*d*of FIG. 1*b*.
Figure 13B:
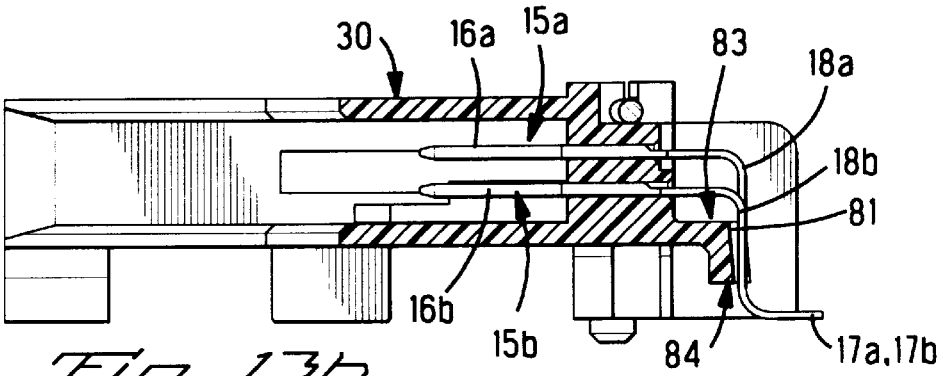
Figure 13C:
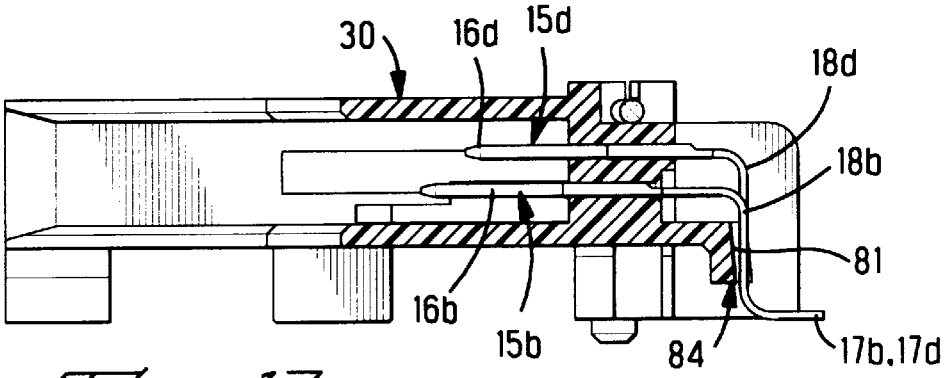
Figure 13D:
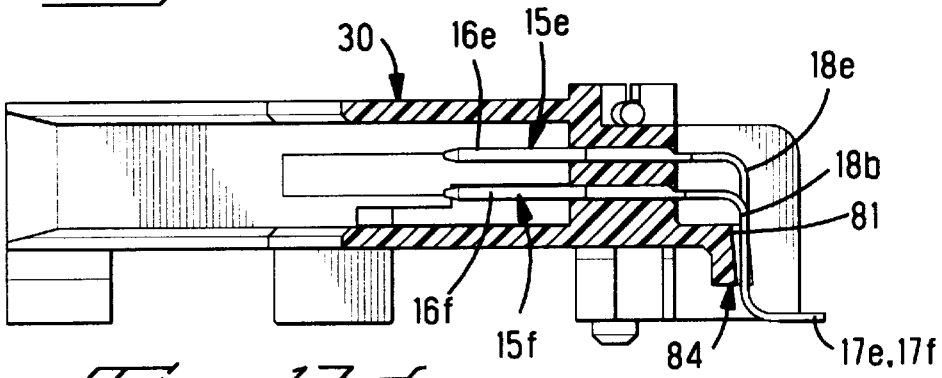
Figure 14A:
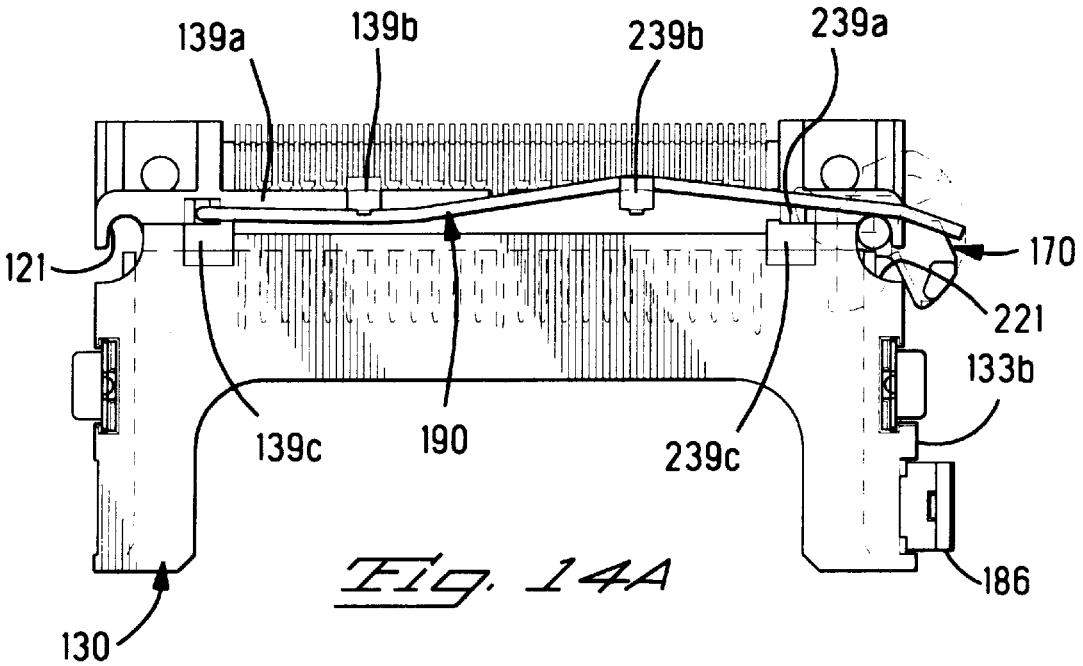
FIG. 14*a* is a top plan view of an alternative embodiment of the card connector.
Figure 14B:
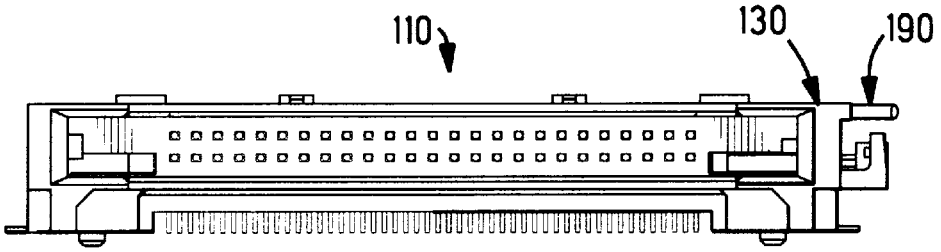
FIG. 14*b* is a view looking from the bottom of FIG. 14*a*.
Figure 15A:
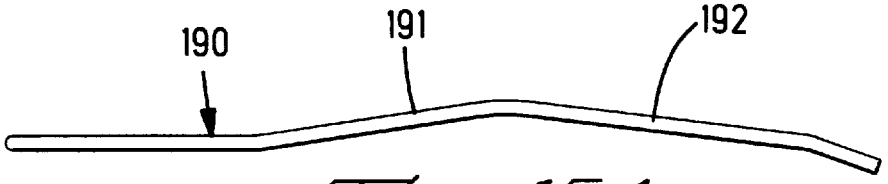
FIG. 15*a* is a top plan view of a spring member used in the card connector shown in FIGS. 14*a*, 14*b*.
Figure 15B:
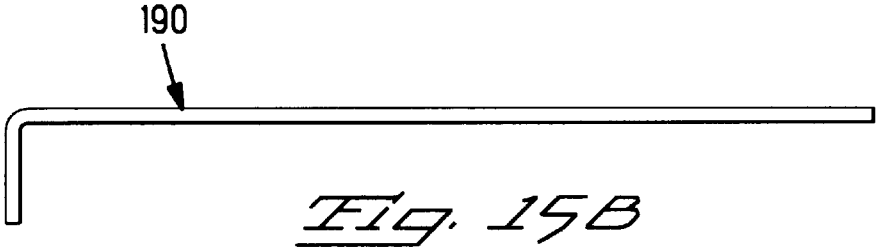
FIG. 15*b* is a view looking from the bottom of FIG. 15*a*.
Figure 16A:
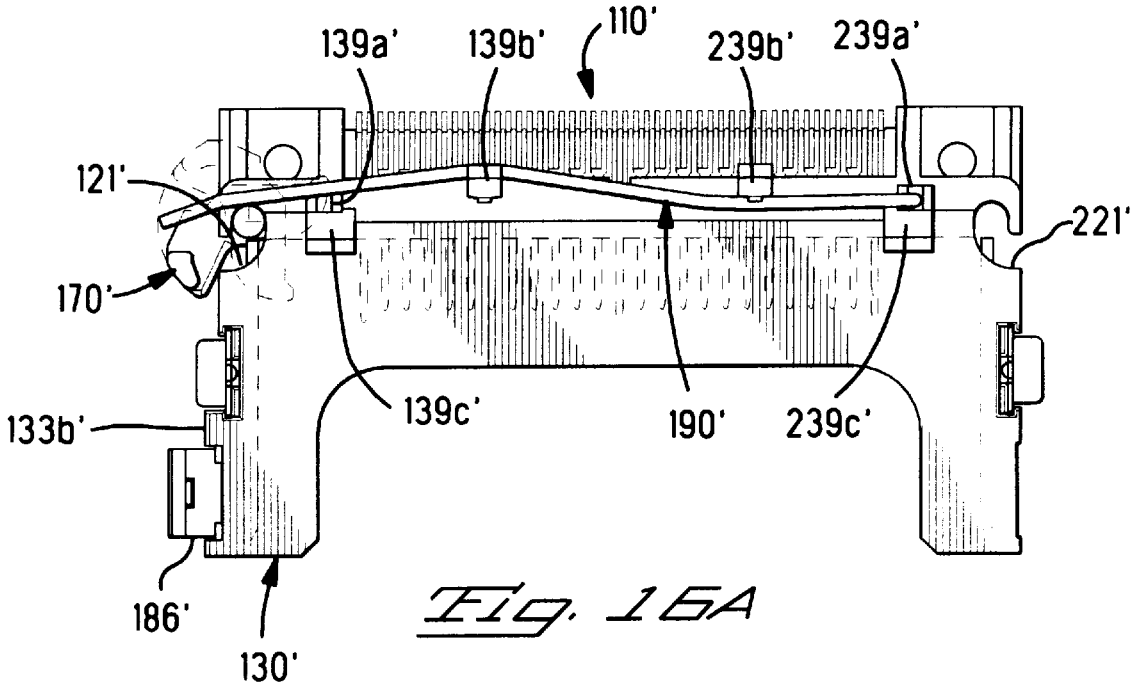
FIG. 16*a* is a bottom view of a card connector wherein the housing has basically the same configuration as that of the card connector shown in FIG. 14*a*.
Figure 16B:
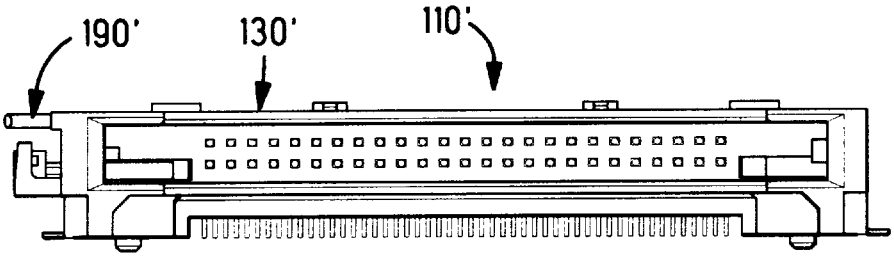
FIG. 16*b* is a view looking from the bottom of FIG. 16*a*.

During the fourth stage of assembly, the pressure applied to the lever 50 in the direction indicated by arrow C is relieved. This results in a force applied to the lever 50 by the spring 90 in the opposite direction indicated by arrow D in FIG. 11. At that time, as shown in FIG. 11, the catch 55 is engaged with the shoulder 39 of the key 37*a*, thus preventing the lever 50 from further movement in the direction indicated by arrow D. It should be noted that at this time the spring 90 is only slightly deformed. As a result of the operations described above, the lever 50 becomes movably mounted on the housing 30, thus completing the assembly of the card connector 10. In this state, the cam member 70 can freely rotate to any position, for example to the position shown in FIG. 11. However, when a card is inserted in the card connector 10, the card engages against the ejection section 71 thereby turning the cam member 70. When the card is fully inserted, the cam member 70 assumes the position shown in FIG. 1 in which the card is in contact with the ejection section 71, thus enabling ejection of the card.

As can be seen from FIGS. 13*a*–13*d*, multiple contacts 15*a* –15*f* are arranged in the connector for sequential connection. Contact pairs 15*a*, 15*b* shown in FIGS. 13*a*–13*c*, located at the sides of the connector and contact pair 15*a*, 15*b* located in the center of the connector have long contact sections 16*a*, 16*b*, and they are used for power supply. Contact pair 15*c*, 15*d*shown in FIGS. 13*a*, 13*c*have the short contact sections 16*c*, 16*d*; they are used for the detection of the card position. Typical contacts 15*e*, 15*f* shown in FIG. 13*d* have contact sections 16*e*, 16*f* of an intermediate length between lengths of contact sections 16*a*, 16*b* and 16*c*, 16d. Contacts 15*e*, 15*f* are used for the transmission of signals. All contacts 15*a*–15*f* have post sections 18*a*–18*e*, including surface mounting sections 17*a*–17*e*. Tie-ins 18*a*–18*e* are brought out from the housing 30 through slots 81 made in the back wall of the housing and are arranged in one row. As can be seen from FIG. 13*a*, slots 81 have an oblique surface 82 whose top edge is separated from the post sections 18*a*–18*e*, and whose lower edge 84 is located closer to the post sections 18*a*–18*e*. Such a configuration is provided to compensate for allowances made during assembly.

FIGS. 14–17*b* show an alternative embodiment of the card connector according to this invention.

The difference between card connectors 110, 110' of the alternative embodiment of this invention shown in FIGS. 14–17*b* and the card connector 10 is mostly in the way the spring is secured on the housing and in the configuration of the spring. As can be seen from FIGS. 14*a*, 14*b*, 16*a*, 16*b*, card connectors 110, 110' differ by the side to which the ejection cam member 170, 170' is mounted. Card connectors 110, 110' have pairs of openings 139*a*, 239*a* and 139*a*', 239*a*'; pairs of lugs 139*b*, 239*b* and 139*b*', 239*b*' and pairs of temporary retention lugs 139*c*, 239*c* and 139*c*', 239*c*'. Housings 130, 130' also have on both their sides matching recesses 121, 221 and 121', 221'. Similar to the connector shown in FIG. 1, connectors depicted in FIGS. 14 and 17 have levers engaged with cam members 170, 170' which are arranged along side 133*b*, 133*b*' of the housings 130, 130' (these levers are not shown in FIGS. 14 and 17). As can be seen from the plan view of the springs 190, 190' for card connectors 110, 110', they are not straight. The first oblique sections 191, 191' and the second oblique sections 192, 192' form bulges facing forward.

Figure 17A:
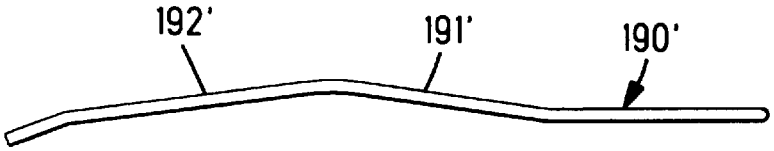
FIG. 17*a* is a top plan view of a spring member used in the card connector shown in FIGS. 16*a*, 16*b*.
Figure 17B:
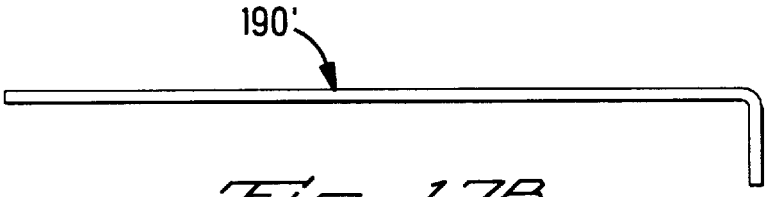
FIG. 17*b* is a view looking from the bottom of FIG. 17*a*.

The advantage of structures shown in FIGS. 14 and 17 is that the same metal parts can be used in both of the housings 130 and 130'. The difference between the housings 130, 130' is that slots for the lever-supporting arms 186, 186' are formed on different sides of the housings. Therefore, lever-supporting arms 186, 186' can be used interchangeably in either of the housings 130, 130'. This makes it possible for the customers to quickly change configuration of equipment to better suit their preferences. The purpose of bulged sections of springs 190, 190' formed by oblique sections 191, 191' and 192, 192' is to extend along lugs 239*b*, 139*b*, which are not used in the selected configuration, thus making it possible to modify connectors.

Figure 18:
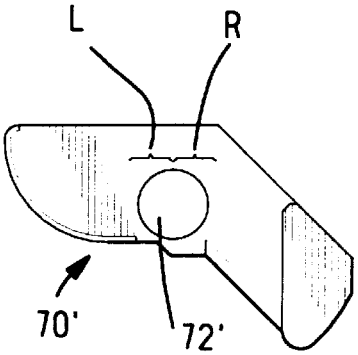
FIG. 18 is a top plan view of an alternative embodiment of the cam member.

Above, explanations concerning embodiments of card connectors according to this invention have been provided, which are used as examples and do not limit the scope of the invention in any way; it is a matter of fact that changes and modifications can be introduced by experts in the field. As an example of possible modifications, it is possible to use a cam member 70' shown in FIG. 18. The specific feature of the cam member 70' is that the pivot 72' has an oval rather than round cross section, and that on the right side R the curvature is smaller (that is, the radius of the curve is larger) than on the left side L. Because of such configuration, card ejection can be initiated by a shorter stroke of the lever but the ejection will require a greater effort at the beginning which will decrease as the ejection progresses. This results in a smoother operation of the card-ejection mechanism.

The first specific feature of the card connectors according to this invention is that a recess is formed in the housing with an opening to a side of the housing and a cantilevered arm overlaps the recess. When the cam member is mounted through the opening in the side of the housing, the cantilevered arm is bent, and when the cam member reaches its predetermined position, the cantilevered arm returns to its initial position locking the cam member in place while allowing it to rotate, thus making it possible to simplify the installation of the cam member which is an essential part of the card-ejection mechanism. Such a structure makes it possible to implement assembly by automatic machinery. The second specific feature of the card connectors according to this invention is that a spring provides at all times pressure to a lever in the direction opposite to that of its insertion, it is made of a metal wire; and, due to the fact that it is mounted on the housing practically perpendicular to the direction of the sliding motion of the lever, spring configuration is substantially simplified and its installation is much easier. Such a configuration provides for an easy linking of the spring to the lever.

I claim:

1. A card connector, comprising:

a housing having a card-receiving section into which a card can be received;

a side of said housing having a recess;

a cantilever arm on said housing overlapping said recess;

a cam member disposed in said recess and maintained therein by said arm;

a lever mounted along said side engaging said cam member and slidable along said side relative to said housing to operate said cam member to eject the card from the housing; and a spring mounted on said housing engaging said lever urging said lever to a non-ejecting position.

2. A card connector as claimed in claim 1, wherein said recess is located in a wall of said housing and includes a space in communication with said card-receiving section.

3. A card connector as claimed in claim 2, wherein said recess is curved toward a front end of said housing, a first pivot member of said cam member disposed in said recess.

4. A card connector as claimed in claim 3, wherein a second pivot member of said cam member is engaged by said arm so that said first pivot member is disposed in the curved recess and maintained therein.

5. A card connector as claimed in claim 1, wherein said cam member has an engaging section for engagement with said lever.

6. A card connector as claimed in claim 5, wherein said cam member has a card-ejection section extending into said card-receiving section for engaging the card to eject the card from the housing.

7. A card connector as claimed in claim 1, wherein said spring is a linear spring having one end pivotally mounted in said housing and a free end engaging said lever.

8. A card connector as claimed in claim 7, wherein said free end is bent.

9. A card connector as claimed in claim 8, wherein said spring extends along a front end of said housing, lugs are spaced along said front end against which said spring engages.

10. A card connector as claimed in claim 1, wherein said spring has a first oblique section and a second oblique section.

11. A card connector as claimed in claim 8, wherein a forward end of said lever has a U-shaped groove in a front end thereof in which a free end of said spring is disposed.

12. A card connector as claimed in claim 1, wherein spaced keys are located along said side of said housing, a lever-supporting arm is disposed between said spaced keys, said lever having spaced slots corresponding to said spaced keys along which said spaced keys are disposed when said lever is mounted along said side.

13. A card connector as claimed in claim 12, wherein said lever has an L-shaped slot into which a rib on said lever-supporting arm is disposed.

14. A card connector as claimed in claim 1, wherein said cam member has an oval-shaped pivot member.

15. A card connector comprising a housing having a card-receiving section in which a memory card is received, a card-ejection mechanism on the housing for ejecting the memory card from the card-receiving section wherein said card-ejection mechanism comprises:

a card-ejection member pivotally mounted in a space in the housing in communication with the card-receiving section and having an ejection section extending into the card-receiving section for engaging the memory card to eject the memory card from the card-receiving section;

a lever slidably mounted on the housing and engageable with an operating section of said card-ejection member to operate said card-ejection member; and a spring extending along a front end of the housing and engaging a front end of said lever to bias said lever to a non-ejecting position.

16. A card connector as claimed in claim 15, wherein a cantilever arm is provided on the housing engaging a pivot member of said card-ejection member thereby maintaining said card-ejection member in position in the space of the housing.

17. A card connector as claimed in claim 15, wherein said spring is a linear metal wire having one end pivotally mounted in the housing and a free end disposed in a groove at an end of said lever.

18. A card connector as claimed in claim 15, wherein a lever-supporting arm is provided on a side of the housing on which the lever is slidably mounted.

19. A card connector as claimed in claim 15, wherein said card-ejection member is freely movable in the space of the housing.

* * * * *